United States Patent [19]

Amos et al.

[11] Patent Number: 4,796,480

[45] Date of Patent: Jan. 10, 1989

[54] CONSOLE MOUNTED CONTROLLER

[75] Inventors: Barry L. Amos, London; Ronald Sapelak, Belmont; Peter Vanderweg, London, all of Canada

[73] Assignee: General Motors of Canada Limited, Oshawa, Canada

[21] Appl. No.: 74,995

[22] Filed: Jul. 17, 1987

[51] Int. Cl.[4] ..... G05G 11/00

[52] U.S. Cl. ..... 74/483 R; 200/5 R; 200/18; 200/43.04

[58] Field of Search ..... 74/483 R; 200/5 R, 18, 200/43.04

[56] References Cited

U.S. PATENT DOCUMENTS

| | | | |
|---|---|---|---|
| 2,185,044 | 12/1939 | Tritle | 74/483 |
| 2,409,762 | 10/1946 | Janes | 74/483 R |
| 2,647,415 | 8/1953 | Dean et al. | 74/483 |
| 2,784,265 | 3/1957 | Weide | 200/5 R |
| 3,410,151 | 11/1968 | Adams et al. | 74/483 |
| 3,710,055 | 1/1973 | Blonn, Sr. | 200/153 R |
| 3,842,653 | 10/1974 | Blonn, Sr. | 74/878 |

*Primary Examiner*—Leslie A. Braun
*Assistant Examiner*—Scott Anchell
*Attorney, Agent, or Firm*—Robert J. Outland

[57] ABSTRACT

An electro-mechanical controller for railway locomotives and other applications is arranged with separate throttle/dynamic brake and reverser handles pivotable on a common, preferably horizontal, axis. Various mechanical interlocks are provided to meet established AAR requirements in a compact assembly arranged for console mounting.

11 Claims, 5 Drawing Sheets

CONSOLE MOUNTED CONTROLLER

TECHNICAL FIELD

This invention relates generally to an electro-mechanical controller and more particularly to an improved master controller intended primarily for use on diesel electric locomotives although capable of other applications.

BACKGROUND

The use of relatively complex manually actuated electro-mechanical mechanisms to control many of the operating functions of diesel electric locomotives and the like is well known in the art. Examples of types of prior art controllers which have been used in the past or proposed for use on diesel electric locomotives and the like are shown for example in U.S. Pat. Nos. 2,409,762 Janes, 2,784,265 Weide and 3,710,055 Blonn, Sr., all previously granted to the assignee of the present invention. While there are substantial differences, as well as similarities, in the arrangements of these various prior art controllers, they share the similarity that their illustrated embodiments are particularly intended for installation in control stands, or similar applications, wherein the various control handles extend generally horizontally and are pivotable about generally vertical axes.

More recently, an application arose for a new design of electro-mechanical controller intended to accomplish many of the same functions as the prior art devices but particularly adapted to be mounted in a console with control handles extending upwardly from an upper surface and pivotable about a generally horizontal common axis. In addition, the new controller was required to fit generally in the available space and to have the arrangement and operation of the control handles functionally similar to those of an electronic controller used previously in the locomotive application.

It was also required that the new controller include interlocking features stipulated by the Association of American Railroads (AAR). These included the following requirements:

(1) The reverser handle must be removable by the operator but only when the throttle handle is in the idle position. The reversal handle must be removable only when it is in the neutral position.

(2) When the reverser handle is removed, the throttle handle must remain locked in the idle position.

(3) The throttle/dynamic brake handle must not be movable into the dynamic brake region unless the reverser handle is in either the forward or reverse position.

(4) The reverser handle must be movable to forward or reverse positions only when the throttle handle is in the idle position.

Additionally, it was desired to provide a gate arrangement for the throttle/dynamic brake handle that requires two separate motions to move the handle from the power position to the dynamic brake position and vice versa.

SUMMARY OF THE INVENTION

The present invention meets the various design objectives and the AAR requirements for mechanical interlocking. It provides a compact controller for locomotives and the like which is intended for and capable of console mounting with the throttle and reverser handles pivotable on a common horizontal axis. The throttle handle also acts to control dynamic braking in a separate portion of its travel reached by traversing a gate.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
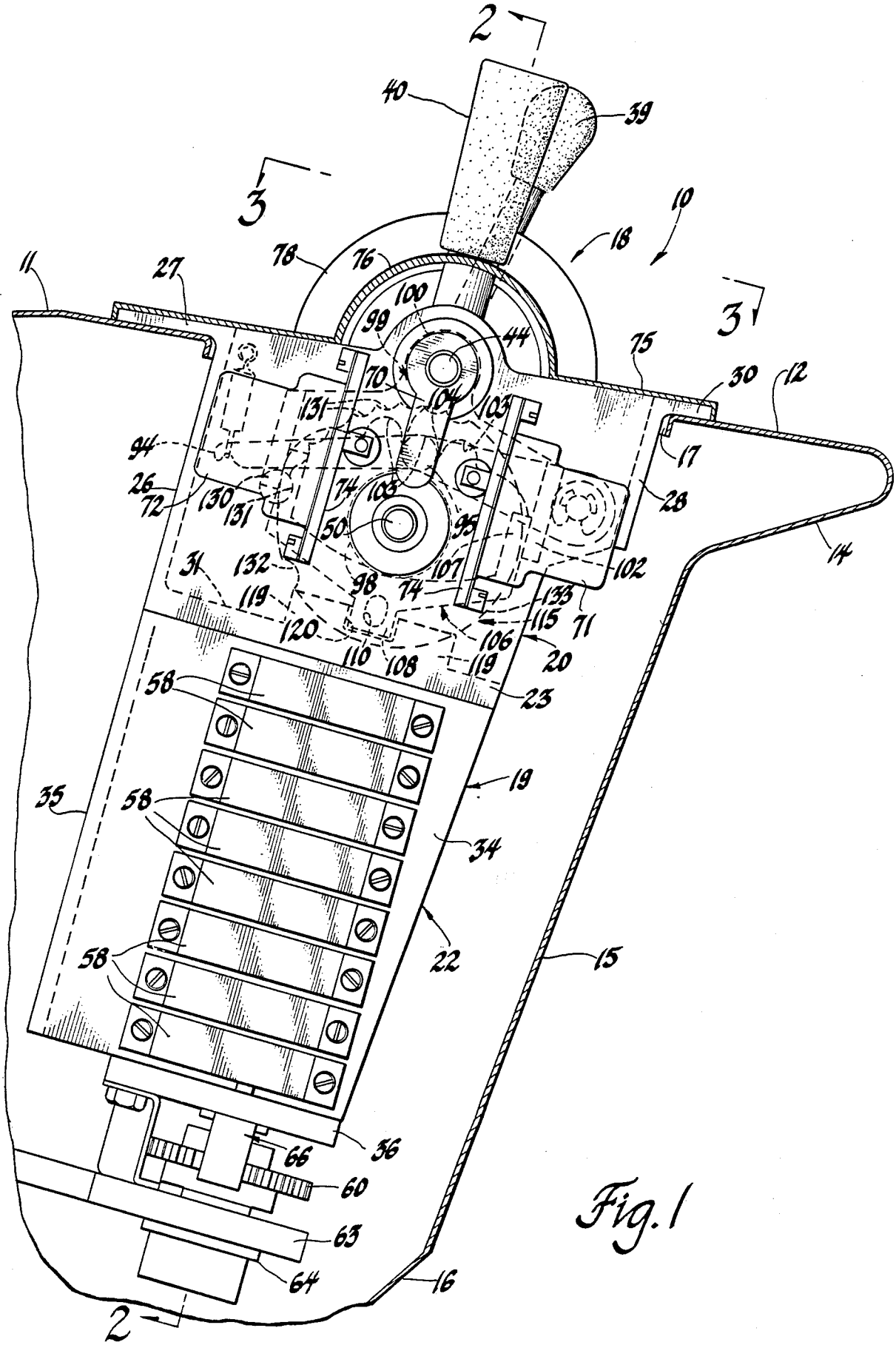
FIG. 1 is a longitudinal cross-sectional view through a portion of a locomotive console and the associated controller cover plate showing a side view of a controller formed in accordance with the invention.

Referring now to the drawings in detail, numeral 10 generally indicates an operating console as installed in the cab of a diesel electric locomotive or the like and having an upper surface including a generally flat front shelf 11 and a mounting surface 12 sloping downwardly from the front shelf toward the position of an operators seat (not shown). The console further includes a reversely angled lip 14 extending back under the mounting surface and connecting with a backwardly angled rear wall 15 joined at its lower edge with a more steeply angled kickboard 16. An opening 17 through the mounting surface 12 is provided for mounting a controller.

Carried on the mounting surface 12 and extending through the opening 17 into the console behind the back angled front wall 15 is a controller generally indicated by numeral 18 and of a type formed according to the invention. The controller 18 includes a body 19 which may be roughly divided into an upper mechanical section 20 and a lower electrical section 22.

The mechanical section of the body includes oppositely disposed left and right side walls 23, 24 respectively, a front wall 26 interconnecting the side walls and connected at its upper edge with a forwardly extending front mounting flange 27, and a partial rear wall 28 interconnecting rearwardly extending portions of the side walls 23, 24 and connected at its upper edge with a rearwardly extending mounting flange 30. The walls 23, 24, 26, 28 extend downwardly through the opening 17 in the console mounting surface 12 and te lips 27, 30 seat on and are fastened, by means not shown, to the mounting surface 12 so as to fix the controller to the console. A central wall 31 connecting with the side walls 23, 24 and the front wall 26 closes the bottom of the mechanical section and separates it from the electrical section 22 below.

Extending downwardly from the central wall, the electrical section of the body includes a lower right side wall 32 forming a downward extension of the upper right side wall 24, a lower left side wall 34 extending downwardly from the central wall 31 and parallel with but set in a substantial distance from the upper left side wall 23 and a lower front wall 35 forming a downward extension of the upper front wall 26. Also, a relatively heavy partial bottom wall 36 extends laterally between the right side wall 32 and the left side wall 34 at their portions spaced rearwardly of the front wall 35 and extends further to the left of the side wall 34 so as to provide a cantilevered body portion.

Within the upper mechanical section of the controller body, a partition 38 is fixed to and extends inwardly from the rear wall 28 intermediate the side walls 23, 24 to roughly divide the upper portion of the mechanical section into two portions, one of which contains a throttle/dynamic brake handle 39 and the other of which contains a reverser handle 40. Both handles extend upwardly above the open top of the controller body to positions above the console for easy actuation by an operator.

The throttle handle 39 is pivotably connected with a generally horizontal throttle shaft 42 that is carried for oscillation in the partition 38 and an upper portion of the upper side wall 24. The handle 39 is maintained generally at right angles to the throttle shaft 42 by a spring plunger 43 carried on the handle and engaging the shaft to urge the handle into the normal position but allow limited pivoting to the right as viewed in FIG. 2.

On the other side of the partition 38, the reverser handle 40 is removably carried in an upper (reverser) shaft 44 which is supported for oscillation on the same axis as the throttle shaft 42 by the inner end 46 of the throttle shaft and the upper portion of the left side wall 23 of the controller body.

To perform its throttle controlling functions, the throttle handle 39, through the shaft 42, is connected with a partial gear 47 carried on the throttle shaft on the far side of partition 38. Gear 47 in turn engages a smaller driven gear 48 fixed on a lower (auxiliary) shaft 50 that is rotatably supported by side walls 23, 24 below and parallel with the throttle and upper shafts 42, 44.

Also mounted on the lower shaft 50 are a bevel drive gear gear 51 and a spur drive gear 52. The bevel gear 51 engages a bevel driven gear 54 carried on one end of a camshaft 55 that extends vertically through and is supported by the central wall 31 and the bottom wall 36. The camshaft 55 carries, in the electrical section between the walls 31 and 36 a cam assembly 56 having a plurality of cams, each engageable with one of a number of limit switches 58 mounted along the lower left side wall 34 of the electrical section.

To carry out an additional function of the throttle handle of acting as a dynamic brake control, the camshaft 55 carries at its lower end a rheostat drive gear 59. This, in turn, engages a driven gear 60 that is fixed on a shaft 62 parallel with camshaft 55 and rotatably carried in the bottom wall 36. A dynamic brake rheostat 63, supported by brackets from the lower wall 36, carries a pivotable arm 64 that is connected with and driven by gear 60. Gears 59 and 60 are partial gears arranged so that gear 60 is driven by gear 59 during only a portion of the motion of the throttle handle as will be subsequently described.

A spring assembly 66 carried on the lower wall 36 includes a spring biased ball 67 that is urged into engagement with the outer periphery of a tooth free portion of gear 60 to frictionally maintain it in any position set by the drive gear 59. The ball 67 also engages a recess 68 in the outer periphery of gear 60 to provide a detent that maintains the gear 60 in a predetermined position when it is not otherwise driven by gear 59.

The reverser handle 40 connects through the upper shaft 44 with a finger 70 fixed on the end of the upper shaft outside the wall 23. The finger, shown in the neutral position, is pivotably movable to engage and actuate either a forward limit switch 71 or a reverse limit switch 72, which are mounted on separate panels 74 extending outwardly from the side wall 23.

A cover 75 is fixed to the flanges 27, 30 of the controller body to cover the open top of the mechanical section. The cover includes raised center portions 76, 78 over the mechanisms associated with the reverser and throttle handle respectively.

An elongated slot 79 in the reverser center portion 76 allows the reverser handle 40 which extends therethrough to be moved into forward and reverse positions. A square edged recess 80 on the side of the slot provides clearance in the neutral centered position of the handle 40 for removal of its key shaped inner end 82, The cover prevents removal of the handle 40 in its forward and reverse positions.

The throttle center portion 78 of the cover is also provided with an elongated slot 83 allowing movement of the throttle handle which extends therethrough, from the idle position illustrated, rearwardly in eight throttle notches to the full engine speed position at one end 84 and forwardly into the dynamic brake operating zone to the full braking position at the other end 86. An offset portion in the middle of the slot cooperates with a projection 87 to form a gate that requires the throttle handle to be yieldingly urged to the right before advancing from the idle position to the brake setup position at the forward end of the gate, and vice versa.

A window 88 provided in the cover portion 78 beside the slot 83 allows viewing of a drum 90, on which are indicated the operating positions of the throttle handle in its power and brake positions. The drum is formed of translucent material backlit by an internal light 91 and is attached to a gear 92 freely rotatable on the throttle shaft 42 and drivably positioned by engagement with the spur drive 52 secured to the lower shaft 50.

Interlocking of the reverser and throttle handle operating mechanisms to meet the AAR requirements indicated previously is accomplished through a number of devices.

A spring biased arm 94, pivotably mounted on the side wall 23 of the mechanical section, carries a detent roller 95. An arcuate cutout 96 in a flange 98 formed on the lower shaft 50 aligns with and receives the roller 95 only when the shaft 50 is positioned, as illustrated, in the idle throttle position.

A reverser arm 99 includes a collar 100 fixed to the upper shaft 44. The collar connects with a pair of oppositely extending arms 102, on the bottom side of which are recesses 103 with intermediate protrusions 104. The recesses 103 coact with the roller 95 of the spring loaded arm 94 to detent movement of the reverser handle in its forward, neutral and reverse positions. The protrusions 104 force the roller 95 into the flange cutout 96 whenever the reverser handle is moved, thus, preventing movement of the reverser handle except when the throttle is in the idle position.

A reverser lock 106 is formed in a somewhat ovalized configuration having a pair of protruding arms 107 that are pivotably carried on the lower ends of the reverser interlock arms 102. Intermediate the support arms 107, the lock 106 includes a lower portion having, at its bottom center, a depending lug 108 and a central pin opening 110. In an upper portion, the lock 106 supports a roller 111 which is engageable with a V-shaped recess 112 in the key-shaped end 82 of the reverser handle 40.

Figure 2:
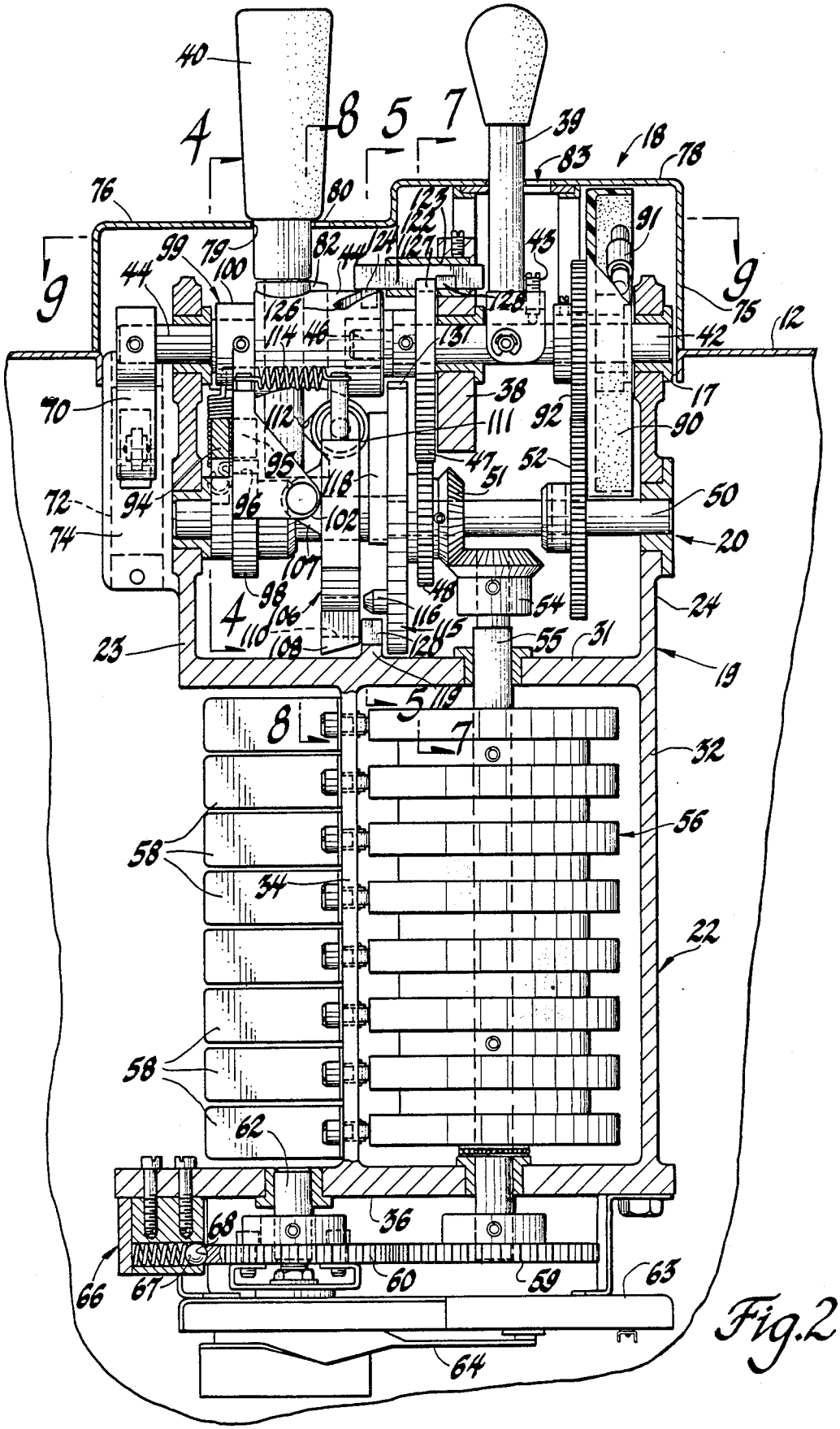
FIG. 2 is a transverse cross-sectional view of the controller from the plane indicated by the line 2—2 of FIG. 1.
Figure 3:
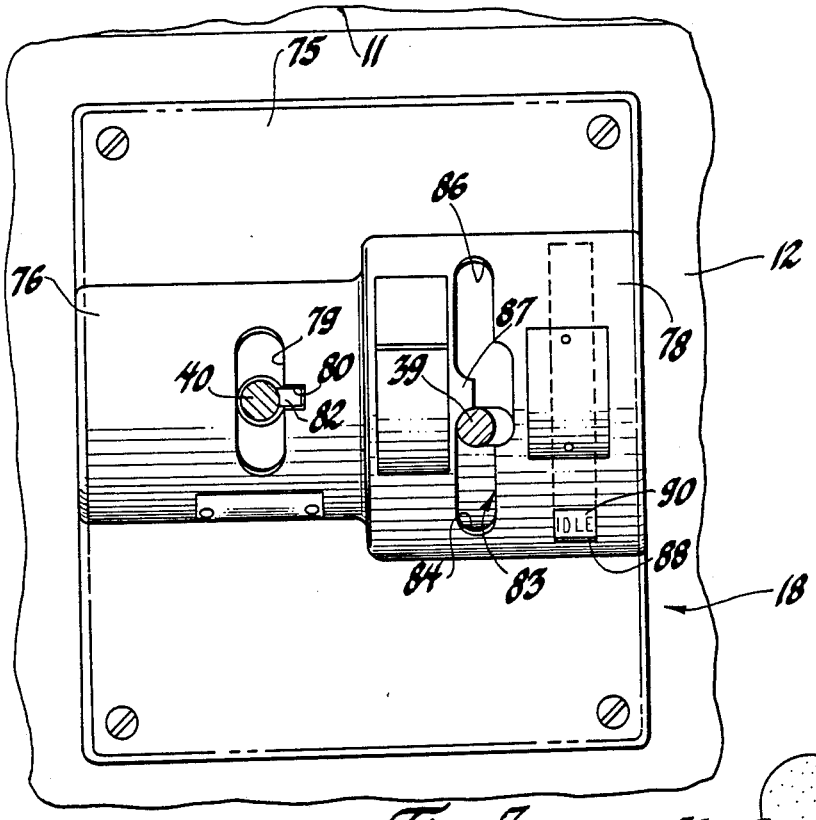
FIG. 3 is a cross-sectional view showing the upper surface of the controller cover from the plane indicated by the line 3—3 of FIG. 1.
Figure 4:
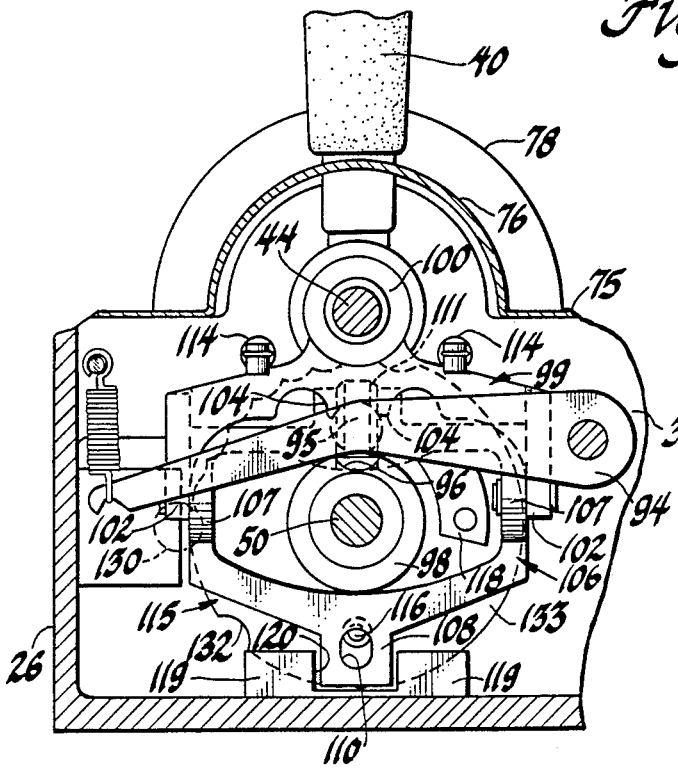
FIG. 4 is a longitudinal cross-sectional view illustrating part of the actuating and interlocking mechanism from the plane indicated by the line 4—4 of FIG. 2.
Figure 5:
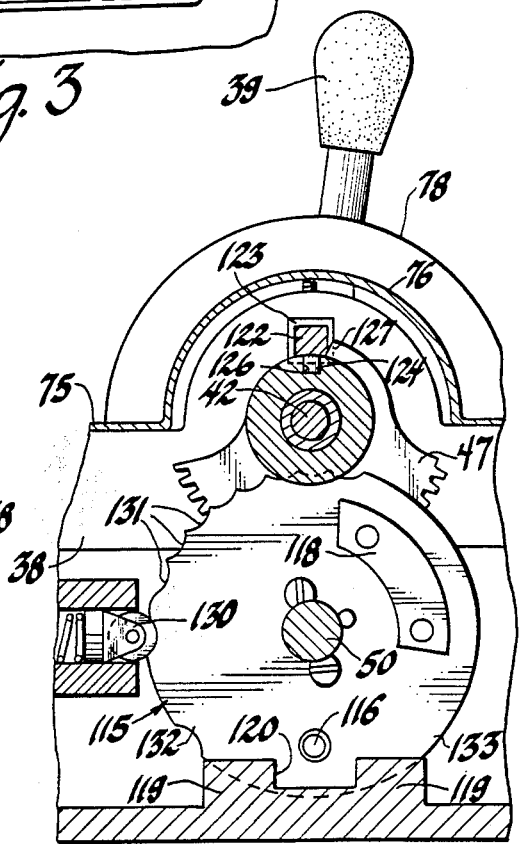
FIG. 5 is a fragmentary cross-sectional view of the mechanism showing the throttle detent plate from the plane indicated by the line 5—5 of FIG. 2.
Figure 6:
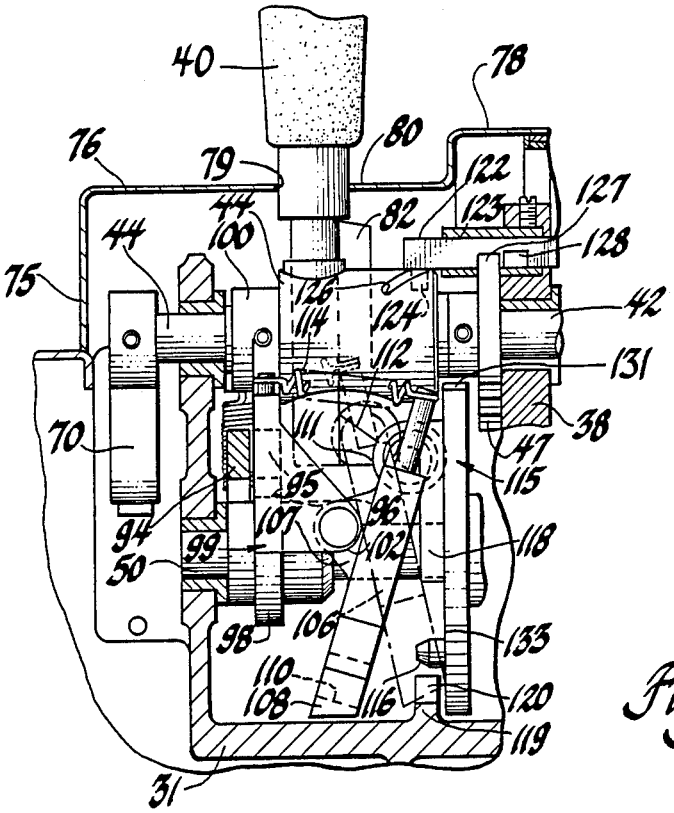
FIG. 6 is a fragmentary cross-sectional view similar to a portion of FIG. 2 but showing differing positions of the reverser lock assembly during and after removal of the reverser handle.
Figure 7:
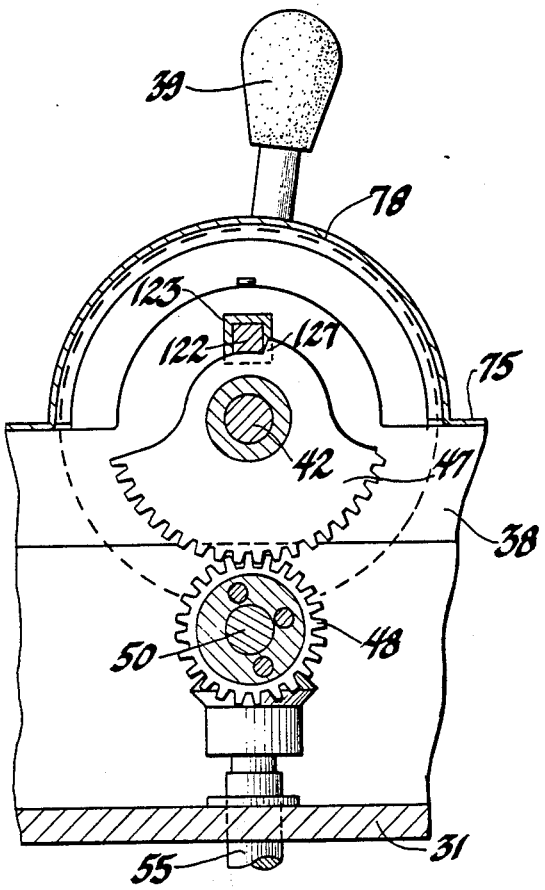
FIG. 7 is a fragmentary longitudinal cross-sectional view of the throttle handle gear drive from the plane indicated by the line 7—7 of FIG. 2.
Figure 8:
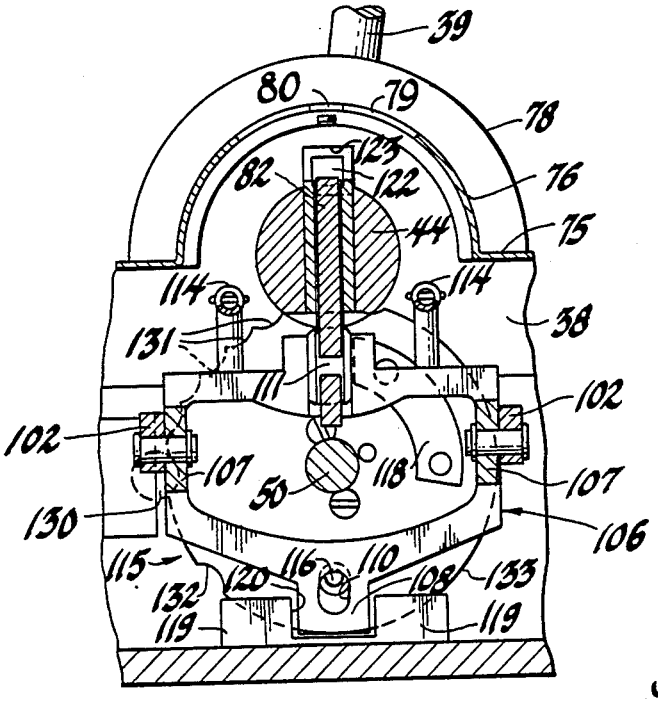
FIG. 8 is a longitudinal cross-sectional view of the reverser handle and lock assembly from the plane indicated by line 8—8 of FIG. 2.
Figure 9:
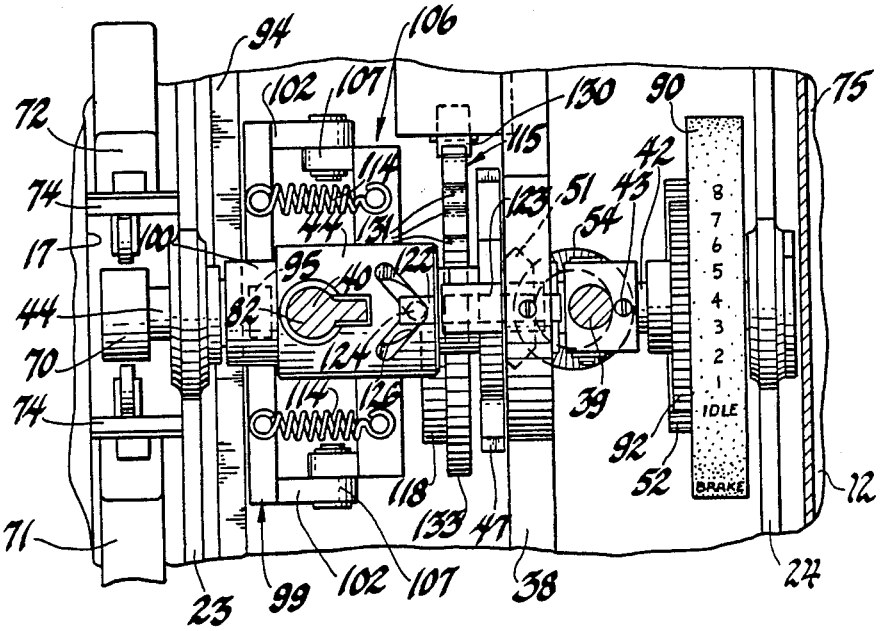
FIG. 9 is a fragmentary cross-sectional view downward on the mechanism from the plane indicated by the line 9—9 of FIG. 2.

Springs 114, extending between spaced upper portions of the reverser arm 99 and lock 106 urge the pivotably mounted lock in a counterclockwise direction, as seen in FIGS. 2 and 6. This holds the roller 111 in the recess 112 when the reverser handle is installed and maintains the lock 106 in a position, generally normal to the lower shaft 50, that permits free motion of the reverser handle.

Fixed in an assembly on the lower shaft 50 with gears 48 and 51 is a detent plate 115 carrying a lock pin 116 adapted to cooperate with the opening 110 of the reverser lock and a ring stop 118 cooperating with the roller 111. A short wall 119, upstanding from the central wall 31, includes a central groove or slot 120 adapted to receive the lug 108 of the reverser lock.

The ring stop 118 prevents the roller 111 from being forced out of the handle recess 112 if the throttle is in any of the power positions. With the throttle in neutral, however, the reverser handle can be removed, causing the roller to first ride up the side of the recess and tilt the lock 106 to the position shown in solid lines in FIG. 6. This is permitted since the roller does not engage the ring stop in this position.

Upon full removal of the reverser handle, the springs 114 pivot the lock 106 counterclockwise to the position shown in dashed lines in FIG. 6. In this position, lug 108 enters the slot 120 in the short wall 119 and the opening 110 surrounds the lock pin 116 on the detent plate 115. This locks the throttle to the housing in the idle position until the reverser handle is again installed.

To prevent the throttle handle from moving into the dynamic brake position when the reverser is in neutral, a slide 122 is reciprocably supported in a bushing 123 fixed in the partition 38. Slide 122 has a pin 124 engaging a V-groove 126 in the reverser upper shaft 44.

When the reverser is in neutral, a stepped portion 127 of the throttle shaft mounted partial gear 47 engages the slide 122, preventing movement of the throttle handle into the dynamic brake position but allowing freedom of movement into the various engine speed setting positions. A notch 128, provided in the slide 122, is positioned in line with the partial gear 47 by the camming movement of the slide away from the throttle handle when the reverser handle is moved to either the forward or reverse position. This allows movement of the throttle handle into the dynamic brake positions.

Feel of the movement of the throttle handle 39 is provided by a detent mechanism including a body mounted spring biased roller 130 engageable with recesses 131 on the periphery of the detent plate. In addition to one recess 131 for each of the eight power throttle positions and idle, there is also a recess 132 for the dynamic brake setup position. The roller 130 rides against an unrecessed portion 133 of the detent plate periphery to provide friction when the handle 39 is moved into the brake zone forward of the setup position.

In operation of the controller, installation of the reverser handle is required to release the lock 106 from engagement with the short wall 119 and the lock pin 116 of the detent plate. The throttle handle 39 may then be moved from the idle position to any of eight throttle notches indicated to the operator by visual operation of the indicating drum 90 as well as by the feel of the detent mechanism. Movement of the throttle handle rotates the throttle shaft 42, gears 47, 48, 51, 54 and camshaft 55, moving the cams of the cam assembly 56 to selectively actuate the limit switches 58 so as to obtain the desired engine speed through electrical connections, not shown, with the engine governor.

When the reverser handle is moved into the forward or reverse position, the finger 70 on the end of the upper shaft 44 engages and actuates the appropriate one of the forward and reverse limit switches 71, 72 to place the locomotive into either forward or reverse operation.

In order to move the reverser handle into the forward or reverse position so as to move the locomotive under its own power, the throttle handle 39 must be placed in the idle position so that the flange recess 96 will be aligned with the roller 95 of the spring loaded arm 94. Then the protrusions 104 can press the roller into the recess 96, allowing the reverser to move into the forward or reverse position.

This action causes the groove 126, acting on the pin 124, to cam the slide 122 away from the throttle handle with the notch 128 in alignment with the partial gear 47. In this position, the throttle handle 39 may be moved into any of the throttle notches to operate the locomotive under power or the throttle handle may be moved through the gate in the cover slot to the dynamic brake setup position and beyond to increase the braking effort.

A braking motion of the throttle handle rotates the camshaft 55 in the opposite direction from a throttle application, causing the toothed portion of the attached gear 59 to engage the toothed portion of gear 60 which is connected with the rheostat arm 64. Movement of the throttle handle from the setup position toward the far end 86 of the slot causes rotation of the rheostat arm 64 on the brake rheostat 63, increasing the locomotive motor field excitation and the corresponding braking effect.

In this portion of the throttle handle travel, the handle and the brake rheostat are held in their selected positions by the friction provided by the detent roller 130 engaging the unrecessed portion of the detent plate 115 and by the ball 67 of the spring assembly 66 engaging an untoothed peripheral portion of the partial gear 60 connected with the rheostat arm 64.

When the throttle handle is returned past the brake setup position to the idle position illustrated, the gear 60 is moved back to the position where the ball 67 engages the recess 68 in the untoothed portion of the gear periphery and the partial gear 59 disconnects from the toothed portion of the gear 60 so that further motion of the throttle handle into the various throttle notches occurs without requiring motion of the brake rheostat.

After operation of the locomotive, removal of the reverser handle first requires the throttle handle to be returned to the idle position so that the partial gear 47 is removed from the slide notch 128 and the cutout 96 of the upper shaft flange 98 is aligned with the roller 95 so that the reverser handle can be moved to the neutral position. Only in this position is the key portion of the shaft end 82 aligned with the recess 80 on the side of the cover slot 79 so that the reverser handle can be removed from the controller.

The throttle handle must be maintained in the idle position or the reverser handle cannot be removed even though it is in the neutral position, since the lock roller 111 will be blocked by the ring stop 118. However, with the throttle handle in idle, the lock 106 is released and, after the reverser handle is removed, engages the wall 119 and pin 116 to positively lock the throttle mechanism to the controller body and maintain the throttle in the idle position.

For locomotives that are not equipped with dynamic brakes, a modification of the disclosed controller can be utilized wherein the rheostat 63 and the associated drive gears 59 and 60, as well as the spring assembly 66, are removed along with two of the throttle limit switches 58 which are utilized for dynamic braking. The slide 122 and the bushing supporting it are also deleted as unnecessary and a new cover plate 75 is applied in which a shorter slot 83 is provided allowing only the throttle actuating portions of the throttle handle motion. Other variations of the assembly and mechanisms described might also be utilized.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. A controller for locomotives and the like, said controller comprising an elongated body having opposite ends defining separate mechanical and electrical portions, a throttle handle and a removable reverser handle both protruding from the mechanical portion end of the body for actuation by an operator, a throttle shaft and a reverser shaft mounted in the mechanical portion of said body for oscillation about a common axis near one end of the body, said throttle handle being pivotally fixed to the throttle shaft for oscillation therewith into an engine idle position and various additional positions and said reverser handle being removably attached to the reverser shaft for oscillation therewith into a neutral position and forward and reverse positions, when installed, electrical reverser switch means mounted on the mechanical portion of the body adjacent to the reverser shaft, reverser switch actuating means fixed to the reverser shaft and engagable with the reverser switch means to actuate them when the reverser shaft is oscillated into the forward and reverse positions, an auxiliary shaft mounted for oscillation in the mechanical portion of the body on a second axis parallel with the common axis and spaced therefrom in the direction of the electrical portion, first drive means connecting the auxiliary shaft with the throttle shaft and causing corresponding oscillation therewith, a switch shaft mounted for oscillation in the electrical portion of the body on a third axis, second drive means connecting the switch shaft with the auxiliary shaft and causing corresponding oscillation therewith, electrical throttle switch means mounted on the electrical portion of the body, and throttle switch actuating means fixed to the switch shaft and engagable with the throttle switch means to actuate them when the switch shaft is oscillated into predetermined positions.

2. A controller as in claim 1 further comprising first interlocking means mechanically locking the reverser shaft to the body and the auxiliary shaft when the reverser handle is removed from the controller to maintain the throttle handle in the engine idle position and to maintain the reverser switch actuating means in the neutral position, said first interlocking means also locking the reverser handle to the reverser shaft except when the the throttle handle and reverser handle are in their idle and neutral positions respectively, and second interlocking means mechanically interlocking the reverser shaft and the auxiliary shaft to prevent movement of the reverser handle into or out of the neutral position unless the throttle handle is in the idle position.

3. A controller as in claim 1 wherein the axis of the switch shaft is disposed normal to the axis of the auxiliary shaft and the second drive means comprise bevel gears.

4. A controller as in claim 3 wherein the first drive means comprise gears.

5. A controller as in claim 1 wherein said throttle handle also controls dynamic braking and said controller further comprises electrical brake switch means mounted on the electrical portion of the body, brake switch actuating means fixed to the switch shaft and engagable with the brake switch means to actuate them when the switch shaft is oscillated into predetermined positions for brake actuation, braking excitation control means mounted on the electrical portion of the body, and third drive means connecting said excitation control means with the switch shaft and operative to cause corresponding movement thereof, at least when the throttle handle is moved into a dynamic brake operating range.

6. A controller as in claim 5 and further comprising first interlocking means mechanically locking the reverser shaft to the body and the auxiliary shaft when the reverser handle is removed from the controller to maintain the throttle handle in the engine idle position and to maintain the reverser switch actuating means in the neutral position, said first interlocking means also locking the reverser handle to the reverser shaft except when the the throttle handle and reverser handle are in their idle and neutral positions respectively, second interlocking means mechanically interlocking the reverser shaft and the auxiliary shaft to prevent movement of the reverser handle into or out of the neutral position unless the throttle handle is in the idle position, and third interlocking means mechanically interrelating the throttle shaft and the reverser shaft to prevent movement of the throttle handle into a position for actuating dynamic braking unless the reverser handle is in one of the forward and reverse positions.

7. A controller as in claim 6 wherein the axis of the switch shaft is disposed normal to the axis of the auxiliary shaft and the second drive means comprise bevel gears.

8. A controller as in claim 5 wherein the first drive means comprise gears.

9. A controller for locomotives and the like, said controller comprising a throttle handle and a removable handle both mounted in a body for actuation by an operator, a throttle shaft and a reverser shaft mounted in the body for oscillation about a common axis, said throttle handle being pivotally fixed to the throttle shaft for oscillation therewith into an engine idle position and various additional positions and said reverse handle being removably attached to the reverser shaft for oscillation therewith into a neutral position and forward and reverse positions, when installed, electrical reverser switch means mounted on the body and operatively actuatable by the reverser shaft when it is oscillated into the forward and reverse positions, an auxiliary shaft mounted for oscillation in the body on a second axis parallel with the common axis and spaced therefrom, first drive means connecting the auxiliary shaft with the throttle shaft and causing corresponding oscillation therewith, a switch shaft mounted for oscillation in the body on a third axis, second drive means connecting the switch shaft with the auxiliary shaft and causing corresponding oscillation therewith, electrical throttle switch means mounted on the body, and throttle switch actuating means fixed to the switch shaft and engagable with the throttle switch means to actuate them when the switch shaft is oscillated into predetermined positions.

10. A controller as in claim 9 wherein said throttle handle also controls dynamic braking and said controller further comprises electrical brake switch means mounted on the body, brake switch actuating means fixed to the switch shaft and engagable with the brake switch means to actuate them when the switch shaft is oscillated into predetermined positions for brake actuation, braking excitation control means mounted on the body, and third drive means connecting said excitation control means with the switch shaft and operative to cause corresponding movement thereof, at least when the throttle handle is moved into a dynamic brake operating range.

11. A controller as in claim 10 wherein the axis of the switch shaft is disposed normal to the axis of the auxiliary shaft and the second drive means comprise bevel gears.

* * * * *